US010285882B2

(12) United States Patent
Chun

(10) Patent No.: US 10,285,882 B2
(45) Date of Patent: May 14, 2019

(54) WIRELESSLY CONTROLLED WHEELCHAIR ASSEMBLY WITH TOILET ACCESSIBILITY

(71) Applicant: Kwok Tung Chun, Hong Kong (HK)

(72) Inventor: Kwok Tung Chun, Hong Kong (HK)

( * ) Notice: Subject to any disclaimer, the term of this patent is extended or adjusted under 35 U.S.C. 154(b) by 0 days.

(21) Appl. No.: 15/823,550

(22) Filed: Nov. 27, 2017

(65) Prior Publication Data

US 2018/0200128 A1 Jul. 19, 2018

Related U.S. Application Data

(60) Provisional application No. 62/446,829, filed on Jan. 16, 2017.

(51) Int. Cl.

| | |
|---|---|
| ***A61G 5/10*** | (2006.01) |
| ***A61G 7/10*** | (2006.01) |
| *A61G 5/12* | (2006.01) |

(52) U.S. Cl.

CPC ..... *A61G 5/1002* (2013.01); *A61G 5/104* (2013.01); *A61G 5/1091* (2016.11); *A61G 7/1007* (2013.01); *A61G 5/1035* (2013.01); *A61G 5/1078* (2016.11); *A61G 5/12* (2013.01); *A61G 7/1013* (2013.01); *A61G 2200/52* (2013.01)

(58) Field of Classification Search

CPC .... A61G 5/1002; A61G 5/104; A61G 5/1035; A61G 7/1007; A61G 7/1013; B60L 2200/24; B60L 2200/34

See application file for complete search history.

(56) References Cited

U.S. PATENT DOCUMENTS

| | | | | |
|---|---|---|---|---|
| 5,411,044 A * | 5/1995 | Andolfi | A61G 7/1017 | 135/66 |
| 6,125,957 A * | 10/2000 | Kauffmann | A61G 5/14 | 180/65.1 |
| 8,529,448 B2 * | 9/2013 | McNair | A61B 5/00 | 600/300 |
| 2004/0006422 A1 * | 1/2004 | Fehr | G01C 21/20 | 701/23 |
| 2005/0131740 A1 * | 6/2005 | Massenzio | G01C 21/3415 | 705/2 |

(Continued)

FOREIGN PATENT DOCUMENTS

| | | |
|---|---|---|
| CN | 103110485 A | 5/2013 |
| CN | 105636568 A | 6/2016 |

*Primary Examiner* — Frank B Vanaman

(57) ABSTRACT

A wirelessly controlled wheelchair assembly comprises a wheel driving unit, a seat edge and footrest lifting unit, a back-rest lifting unit and a seat retracting unit. The wheelchair assembly further comprises a microcontroller electronically coupled with the wheel driving unit, the seat edge and footrest lifting unit, the back-rest lifting unit and the seat retracting unit. The microcontroller is configured to execute a plurality of commands to wirelessly control the operating of the wheelchair. The plurality of commands comprises commands for displacing the wheelchair from a source location to a destination location, lifting the user to slightly detach from the seat, opening the seat by retracting the one or more panels of the seat to enable accessibility of a toilet, move the user in the downward direction and reversing the above steps to restore the user in normal sitting posture. A method of operating the wheelchair assembly is also provided.

11 Claims, 12 Drawing Sheets

(56) References Cited

U.S. PATENT DOCUMENTS

| | | | | |
|---|---|---|---|---|
| 2009/0144895 | A1* | 6/2009 | Bostelman | A61G 7/1007 5/87.1 |
| 2011/0009714 | A1* | 1/2011 | Zong | A61B 5/02028 600/301 |
| 2014/0039676 | A1* | 2/2014 | Fernando | G05D 1/024 700/253 |
| 2016/0008191 | A1* | 1/2016 | Lee | A61G 5/04 701/22 |
| 2016/0014252 | A1* | 1/2016 | Biderman | B60L 15/20 455/420 |

* cited by examiner

WIRELESSLY CONTROLLED WHEELCHAIR ASSEMBLY WITH TOILET ACCESSIBILITY

CROSS-REFERENCE TO RELATED APPLICATIONS AND PRIORITY

The present application claims priority from U.S. Provisional Patent Application. No. 62/446,829 dated 16 Jan. 2017, the entirety of which is incorporated herein by a reference.

TECHNICAL FIELD

The present patent application in general relates to a battery powered wirelessly controlled wheelchair and more particularly, relates to a wheelchair with a plurality of mechanisms implemented for toilet accessibility for a user.

BACKGROUND

Advancements in technology have resulted in providing various electro-mechanical apparatuses and/or devices to physically challenged/disabled persons that assists them in performing day-to-day activities. One of such apparatuses and/or devices is a wheelchair that enables a disabled person to move from one location to the other. However, the wheelchair available today has many lacunae that create multiple problems for disabled persons while using the wheelchair. Few of the problems faced by the disabled persons while using the wheelchair for performing the day-to-day activities include accessing a toilet, dirty hands caused due to rolling of the side wheels, height and/or width constraints in passing through any frame or structure, e.g. accessing a toilet bowl or a bed.

One of the primary root causes for the above problems faced by the disabled persons while using the wheelchair is the lack of an effective assembly or device or an apparatus to overcome any movements where there is a concern of height and other ergonomics. Since many of the disabled persons have no natural power to get up for a while, they cannot perform some common human functions like walking or moving from the wheelchair to another place. A major problem, out of the aforementioned problems, faced by any disabled person is a challenge in comfortably accessing a commode/toilet bowl. It is very difficult for a disabled person to get up from the wheelchair and sit on the toilet bowl and thereafter sit back on the seat of the wheelchair after using the toilet. There is likelihood of an occurrence of an accident during such movements which might create lethal injuries that may further worsen the conditions of the disabled person.

Another lacuna faced by the existing wheelchairs being used for accessing the toilet is lack of effective navigation guidance to easily commute from one place to another, e.g. from bed to the toilet. Specifically, the existing wheelchairs lack in providing sufficient measures that can provide a hassle-free commute with accurate distance measurement along with accurate rotation in degrees to the disabled person. Such lack of proper distance and rotation may cause accidents especially during the event of passing through a door frame or through a zig zag passing or any route with multiple twists and turns or routes having narrow passages, etc.

SUMMARY

This summary is provided to introduce concepts related to a wirelessly controlled wheelchair assembly and the concepts are further described below in the detailed description. This summary is not intended to identify essential features of the claimed subject matter nor is it intended for use in determining or limiting the scope of the claimed subject matter.

In one embodiment, a wirelessly controlled wheelchair assembly is described. The wheelchair assembly may further include a wheel driving unit capable of moving the wheelchair from one location to the other. The wheelchair assembly may further include a seat edge and footrest lifting unit capable of moving a seat edge and a footrest of the wheelchair along with a user in upward and downward direction. The wheelchair assembly may further include a back-rest lifting unit capable of moving a backrest of the wheelchair along with the user in upward and downward direction. The wheelchair assembly may further include a seat retracting unit capable of retracting one or more panels of the seat of the wheelchair. The wheelchair assembly may further include a microcontroller electronically coupled with the wheel driving unit, the seat edge and footrest lifting unit, the back-rest lifting unit and the seat retracting unit. The microcontroller may execute a plurality of commands in order to operate the wheelchair. Specifically, the microcontroller may execute one or more commands to operate the wheel driving unit to displace the wheelchair from a source location to a destination location in accordance with a predefined route. In one embodiment, the destination location may indicate a location wherein a toilet vessel is positioned. Further, the microcontroller may execute one or more commands to operate the backrest lifting unit and the seat edge and footrest lifting unit to lift the user in the upward direction to slightly detach from the seat. The microcontroller may further execute one or more commands to operate the seat retractable unit to open the seat by retracting the one or more panels of the seat. The microcontroller may further execute one or more commands to operate the backrest lifting unit and the seat edge and footrest lifting unit to move the user in the downward direction. In one embodiment, the user is moved in the downward direction such that user is enabled to sit on the toilet vessel being made accessible based upon the opening of the seat. The wheelchair assembly may further include a monitoring sub-system comprising a health monitoring unit, a distance measuring unit, an anti-crash unit and an accident monitoring unit. The microcontroller may further be communicatively coupled with a server, wherein the server is configured to transmit the plurality of commands to the microcontroller, and wherein the server is further configured to set the predefined route.

In another embodiment, a method for wirelessly controlling a wheelchair assembly is disclosed. The method may include triggering, via a microcontroller, a wheel driving unit to displace the wheelchair from a source location to a destination location in accordance with a predefined route. In one embodiment, the destination location indicates a location wherein a toilet vessel is positioned. The method may further include operating, via the microcontroller, the backrest lifting unit and a seat edge and footrest lifting unit to lift the user to slightly detach from the seat. The method may further include operating, via the microcontroller, the seat retractable unit to open the seat by retracting the one or more panels of the seat. The method may further include operating, via the microcontroller, the backrest lifting unit and the seat edge and footrest lifting unit to move the user in the downward direction such that user is enabled to access a space below and around the wheelchair. In one embodiment, the user is moved in the downward direction such that user is enabled to sit on the toilet vessel being made accessible based upon the opening of the seat. The method may further include obtaining the predefined route from a server, communicatively coupled with the microcontroller, to move the wheelchair assembly from the source location to the destination location. The method may further include measuring a distance travelled by the wheelchair. The method may further include detecting an obstruction via a plurality of ultrasonic sensors during performing an auto-pilot movement and further by-pass the obstruction. In one embodiment, the method may further include restoring the user to normal sitting position from the toilet accessible position by: operating the backrest lifting unit and the seat edge and footrest lifting unit to move the user in the upward direction such that user is held by the backrest lifting unit and the seat edge and footrest lifting unit; operating the seat retractable unit to close the seat by retracting the one or more panels of the seat; operating the backrest lifting unit and the seat edge and footrest lifting unit to move the user in the downward direction such that the user is enabled to rest on the seat of the wheelchair; and displacing the wheelchair from the toilet location to the source location or any other location set by the user.

BRIEF DESCRIPTION OF THE DRAWINGS

The detailed description is described with reference to the accompanying figures. The same numbers are used throughout the drawings to refer like features and components.

DETAILED DESCRIPTION

The present patent application in general relates to an assembly of a battery powered wirelessly controlled wheelchair and more particularly, relates to a wheelchair with a plurality of mechanisms implemented for enabling toilet accessibility for a user.

The assembly further enables a user of the wheelchair to travel or commute from one position to another position in a floor layout of a building structure by using an auto-pilot command. Such command may comprise one or more programmed instructions to drive the elements inside the wheelchair assembly to commute from one point to the other point. The programmed instructions further enable the drive unit of the wheelchair assembly and subordinate components to perform a plurality of functions to aid the commute.

Secondly, the wheelchair assembly is further equipped with a plurality of electro-mechanical units which facilitate the user to access the toilet vessel. The wheelchair assembly undergoes various transformations to help the user to access the toilet vessel without performing any physical movement like standing and shifting from the wheelchair to the toilet bowl. The assembly is such that the lower space of the seat may be occupied by the toilet vessel and the electro-mechanical units further perform mechanical transformation of the linkages which enable the access to the toilet vessel from the seat.

The wheelchair assembly further comprises a battery, a microcontroller and a plurality of sub-systems comprising a wireless connection sub-system, a monitoring sub-system and a mechanical sub-system. Such subsystems enable the wirelessly controlled wheelchair to drive the wheelchair and to perform toilet accessibility mechanism.

A detailed description of each of the components and their functions is described in the below explanations along with a plurality of figures wherein a preferred embodiment of the present application will be described below in conjunction with the accompanying drawings.

Figure 1:
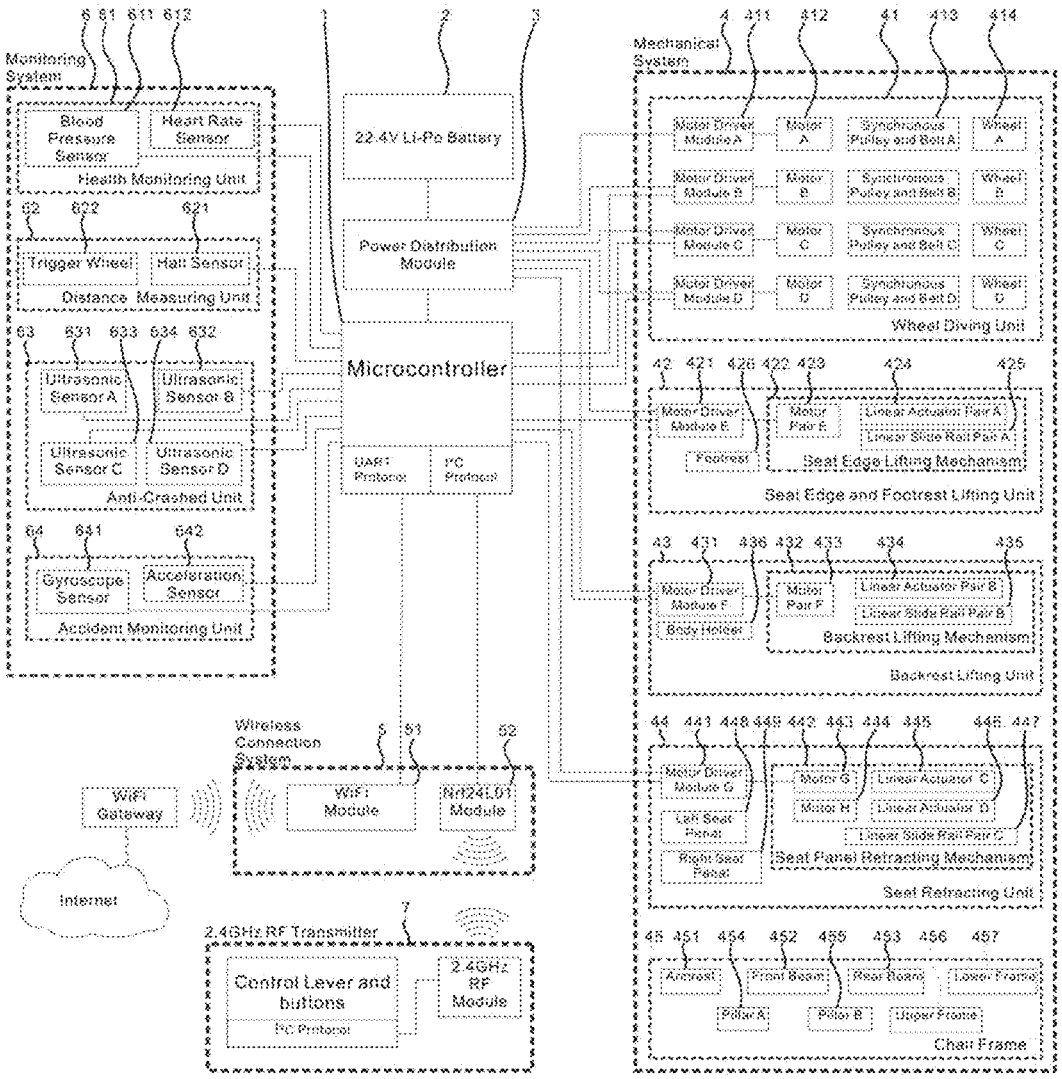
FIG. 1 illustrates a block diagram representing a plurality of components of a wireless controlled wheelchair assembly (hereinafter referred as "wireless assembly" or assembly interchangeably), in accordance with an embodiment of the present application.

FIG. 1 illustrates a block diagram representing a plurality of components of the wheelchair assembly, in accordance with an embodiment of the present application. The wheelchair assembly may further comprise a microcontroller 1, a battery 2, a power distribution module 3, a mechanical subsystem 4, a wireless connection subsystem 5, a monitoring system 6 and a RF transmitter 7.

In one embodiment, the Wireless Connection subsystem 5 may consist of RF and WiFi wireless connection modules and are electrically connected to the microcontroller, enabling the wheelchair to communicate with RF transceiver 7 and the server through the WiFi access point. The RF transceiver 7 may be a 2.4 GHz RF transceiver.

In one embodiment, the microcontroller 1 may be an electronic device that receives power from the power distribution module 3 which is in turn connected to the battery 2. The microcontroller 1 may be electronically connected or integrated with both the Wi-Fi and RF connection module 5 for receiving commands from a Wi-Fi gateway and a RF transmitter (e.g. a 2.4 GHz RF transmitter). In an embodiment, one or more arbitrary and instant commands may be instructed by the RF transmitter 5 while any specific, purposeful and cluster instructions for example assigning a route to single or multiple wheelchairs, are transmitted through Wi-Fi connection.

In an embodiment, the mechanical system 4 may include a driving unit 41, a body holding unit 42, a backrest and backrest lifting unit 43, a seat and seat retracting unit 44, and a chair frame 45.

In one embodiment, the monitoring subsystem 6 may be a cluster of sensors that enables monitoring the health status of user, the moving activity and safety of the wheelchair. The monitoring subsystem 6 may further include a health monitoring unit 61, a distance measuring unit 62, an anti-crashed unit 63 and an accident monitoring unit 64. The health monitoring unit 61 may further include a group of health monitoring sensors further comprising at least a heart rate sensor and blood-pressure sensor enabling periodically collecting the health data. The distance measuring unit 62 and anti-crashed unit 63 may be enabled to measure and compare the distance and detect the obstruction when a series of moving instructions may be received from the server through the Wi-Fi connection. The distance measuring unit may further comprise a trigger sensor 622 and a hall sensor 621. The anti-crash unit 63 may further include a plurality of ultrasonic sensors further comprising at least an ultrasonic sensor A 631, an ultrasonic sensor B 632, an ultrasonic sensor C 633 and ultrasonic sensor D 634. The accident monitoring unit 64 may further include a gyroscope sensor 641 and an acceleration sensor 642.

In one embodiment, the microcontroller 1 may be further electronically connected to the monitoring system 6. The monitoring system 6 may further include various sensors for collecting data from both the surrounding environment and the user. The data collected may be constantly uploaded to the server. More specifically, the health monitoring may collect health parameters comprising heart rate and blood pressure data pertaining to the user and uploads the measured parameters to the server for a daily health record. The distance measuring unit 62 may measure the travel distance and direction of the wheelchair and updates the distance travelled and the direction of the wheelchair to the server. The distance travelled, and the direction of the wheelchair may be used for comparison when a route is assigned to the wheelchair. The anti-crash unit 63 may include a group of ultra-sonic sensors 631~634 located around the wheelchair. The anti-crash unit 63 may be enabled to detect and bypass obstructions when the wheelchair is performing an autopilot movement. Further, the accident monitoring unit 64 may be enabled to trigger and send an alert to the server when unexpected accidents occur, such as crash and fall.

In one embodiment, the chair frame 45 may further include an armrest 451, a front beam 452, a rear beam 453, a pillar A 454, a pillar B 455, an upper frame 456 and a lower frame 457.

In one embodiment, the driving unit 41 may include a plurality of wheels 414 driven by synchronous pulley and belts 413. The power may be generated from electronic motors 412, one motor for one wheel. In an embodiment, each motor is reversible and electrically connected to a motor driver module 411. The motor driver module 411 may be electronically connected to both the microcontroller 1 and the battery 2. The motor driver module 411 may individually control the speed and direction of the motors according to the signals received from the microcontroller 1.

In one embodiment, the seat edge and footrest unit 42 may be an electrical lifting mechanism of which the seat edge lifting mechanism 422 and footrest 426 may vertically move together. The seat edge lifting mechanism 422 may be vertically placed between both sides of the pillar A 454. The seat edge and footrest unit may further include a first motor pair A 423, a first linear actuator pair A 424 and a first linear slide rail A 425. A plurality of nuts of the first linear actuator pair A 424 may be embedded into the front beam 452 of the chair frame 45. The ends of first linear actuator pair A 424 may be directly connected with the motor pair A 423. In an embodiment, the first motor pair A 423 may be electrically connected to the motor driver module E 423 and controlled by the microcontroller 1. The whole seat edge and footrest unit 42 may move upward and downward when the instruction is received though the wireless connection module 5.

In one embodiment, the backrest lifting unit 43 may facilitate a vertical movement mechanism which is embedded into the backrest for lifting the user in upward direction in association with lifting of the seat edge and footrest unit 42. The weight of the upper body of the user may be supported by the body holder 436 and is further transferred to the backrest lifting mechanism 432 as they are integrated together. The backrest lifting mechanism 432 may include all the essential mechanical components for performing the vertical movement. Specifically, the backrest lifting mechanism 432 may include a second motor pair F 433, a second linear actuator pair B 434 and a second linear slide rail pair B 435. In an embodiment, the nuts of second linear actuator pair B 434 may be embedded into the rear beam 453 of the chair frame 45 and the end of the actuators are connected with the motor pair F 433. The vertical movement in upward and downward directions may be facilitated by the rotational direction of the second motor pair F. The clockwise and counter-clockwise rotation can be manipulated by the motor driver module F 431, according to the instruction that is received by the microcontroller 1.

In one embodiment, the seat and seat retracting unit 44 may be a fully integrated mechanism for retracting the left seat panel 448 and the right seat panel 449 without occupying external space out of the wheelchair of the present patent application. Both sides of the seat panels may comprise an inner half panel and the outer half panel which are connected to each other with a hinged connection. In addition to the seat panels, the seat panel retracting mechanism 442 may further include a third motor pair G 443 and H 444, a third pair linear actuator C 445 and D 446 and a third linear slide rail pair C 447. The third pair of linear actuator C 445 and D 446 may be vertically positioned and erected between upper frame 456 and lower frame 457 side by side. In an embodiment, the nuts of the third pair of linear actuator C 445 and D 446 may be fixed with the outer shell of the third pair of linear actuator C 445 and D 446, thus the third pair of linear actuator C 445 and D 446 would be elongated towards the top as the third pair motor G 443 and H 444 are driven by the motor driver module G 441. Furthermore, the outer half panel of both the left seat panel 448 and the right seat panel 449 are pulled up as the third pair of linear actuator C 445 and D 446 are elongating. The position of the both sides of the outer panel may gradually change from horizontal to vertical and may subsequently move upward as the length of elongation is greater than the width of the panel. Since the other side of inner half panel is pivotally connected to the sliding block of the third linear slide rail pair C 447, hence the inner half panel are laterally dragged by the outer panel, and subsequently changes the position gradually from horizontal to vertical as the outer panel starts moving upward. The position of the left seat panel 442 and the right seat panel 445 are eventually retracted vertically under the armrest.

Figure 2:
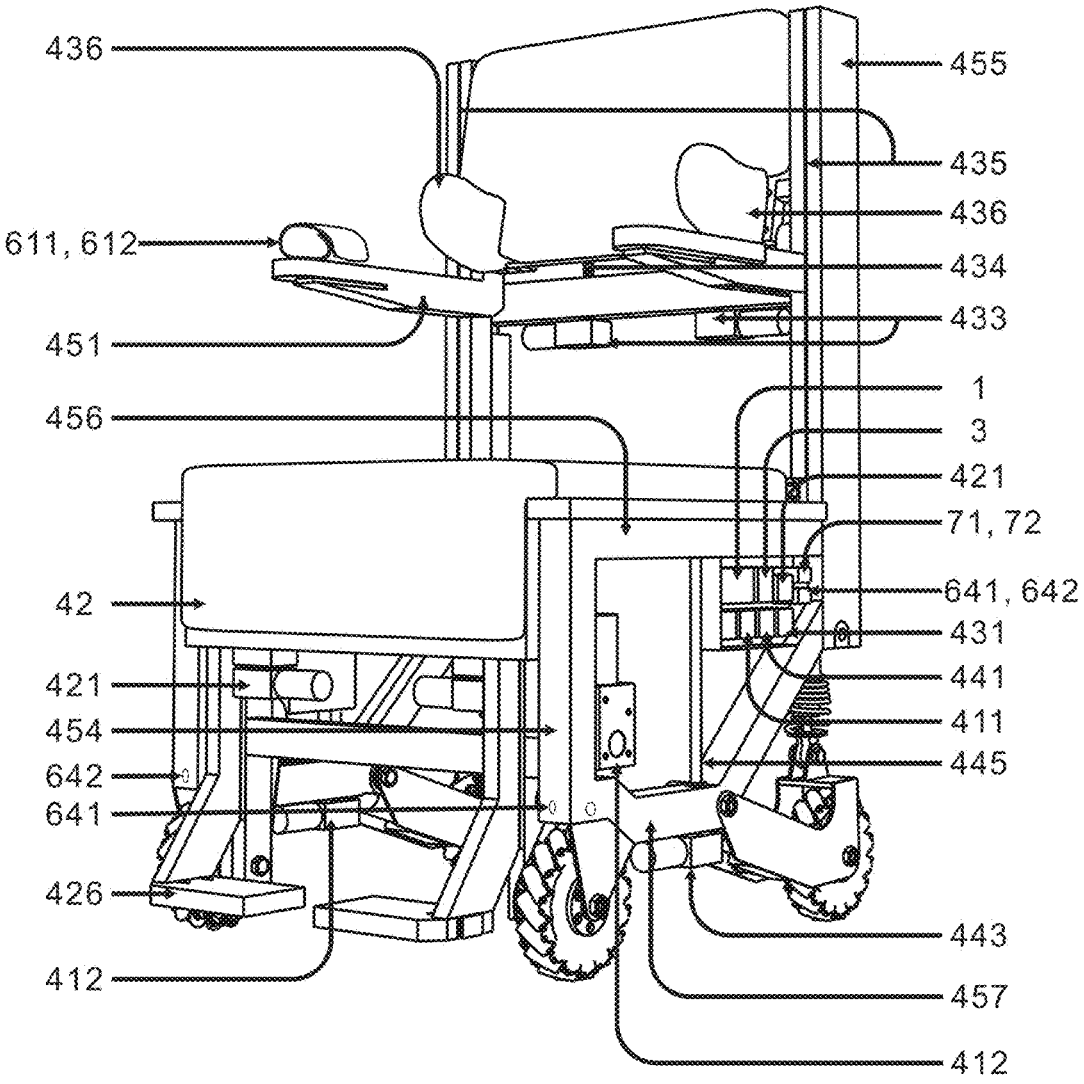
FIG. 2 illustrates a front perspective view of the wheelchair assembly, in accordance with an embodiment of the present application.

Referring to FIG. 2, a front perspective view of the assembly of the wheelchair is illustrated, in accordance with an embodiment of the present application. The wheelchair assembly in this present embodiment is maintained as normal position wherein all the components and the units of the mechanical subsystem 4 are at a position at which the user may comfortably sit on the seat. Furthermore, the backrest, seat edge and footrest are in a lowered position and the seat is in a closed position.

Figure 3:
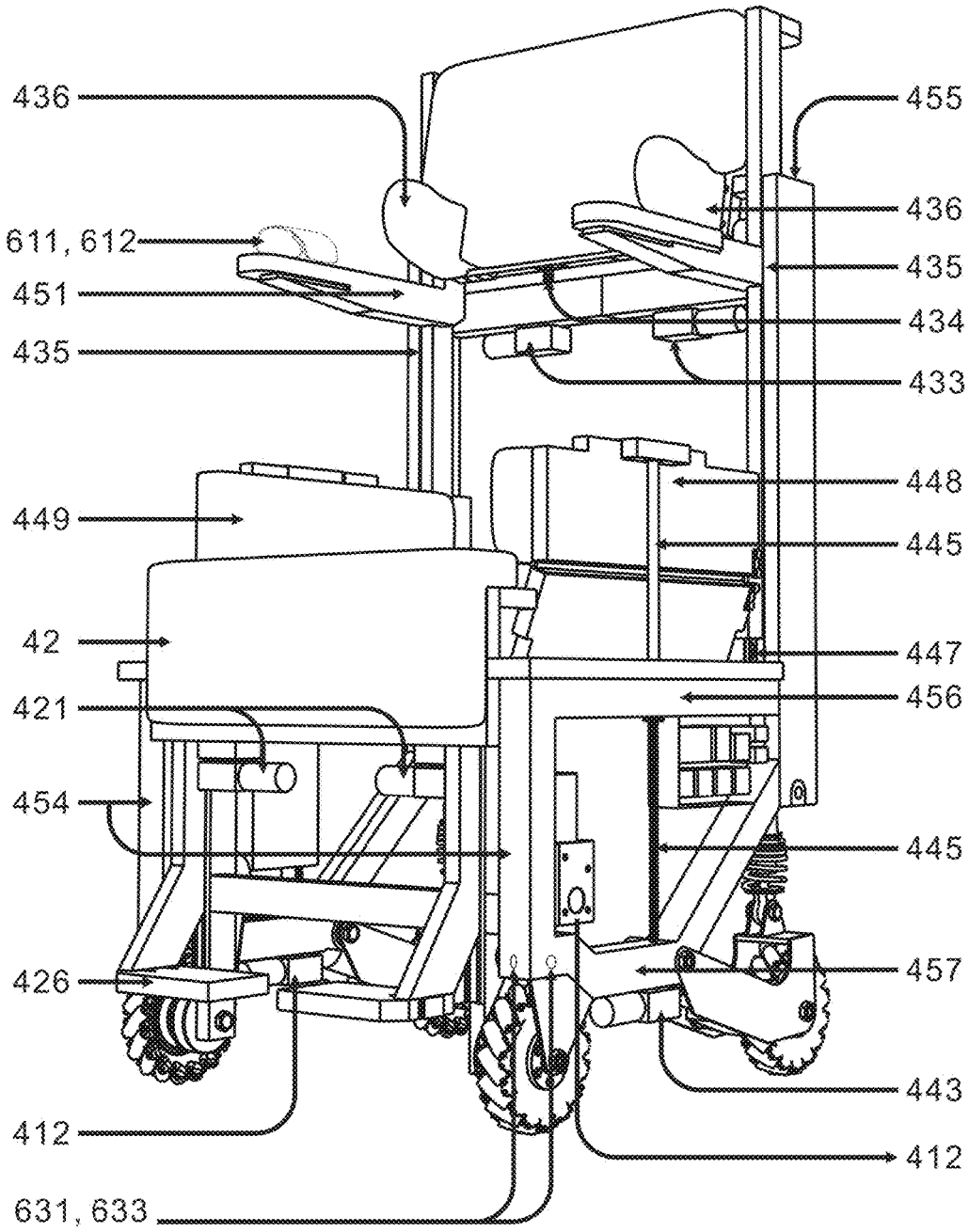
FIG. 3 illustrates an additional front perspective view of the wheelchair assembly, in accordance with an embodiment of the present application.

Referring to FIG. 3, an additional front perspective view of the assembly of the wheelchair is illustrated, in accordance with an embodiment of the present application. The wheelchair assembly in this present embodiment is maintained at raised position wherein the backrest, seat edge and footrest are raised, and the seat is in an open position wherein the seat panels are fully retracted.

Figure 4:
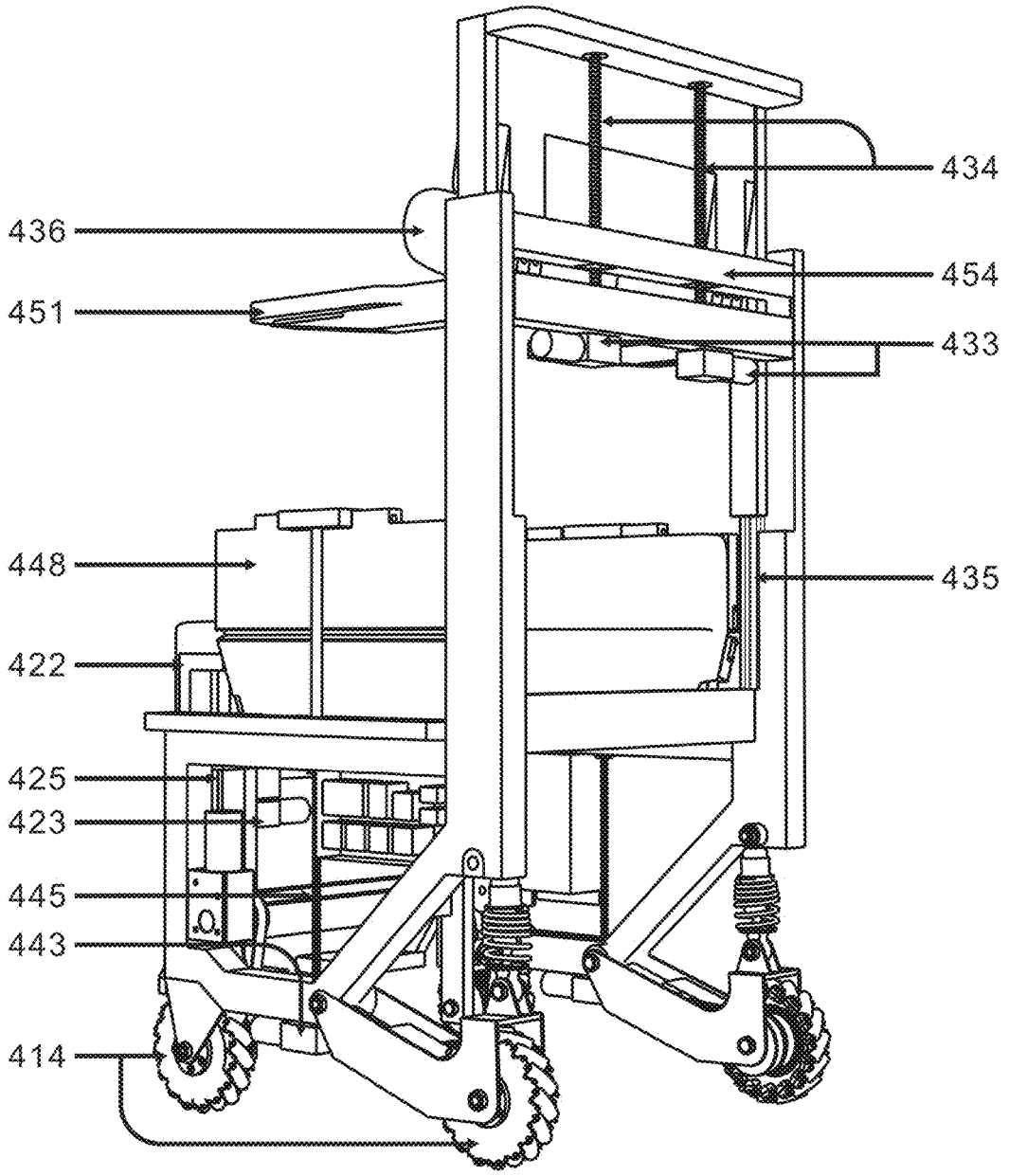
FIG. 4 illustrates a rear perspective view of the wheelchair assembly, in accordance with an embodiment of the present application.

Referring to FIG. 4, a rear perspective view of the assembly of the wheelchair is illustrated, in accordance with an embodiment of the present application. The wheelchair assembly in this embodiment is similar to the arrangement shown in FIG. 3 and is further maintained at raised position wherein the backrest, seat edge and footrest are raised, and the seat is in an open position wherein the seat panels are fully retracted.

Figure 5:
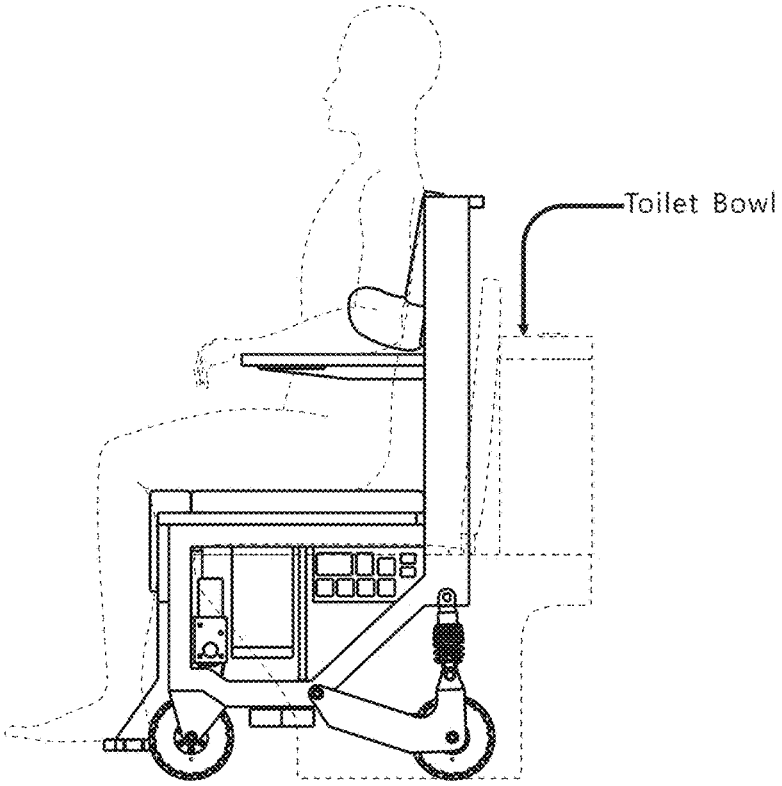
FIG. 5 illustrates a side view of the wheelchair assembly, in accordance with an embodiment of the present application.
Figure 6:
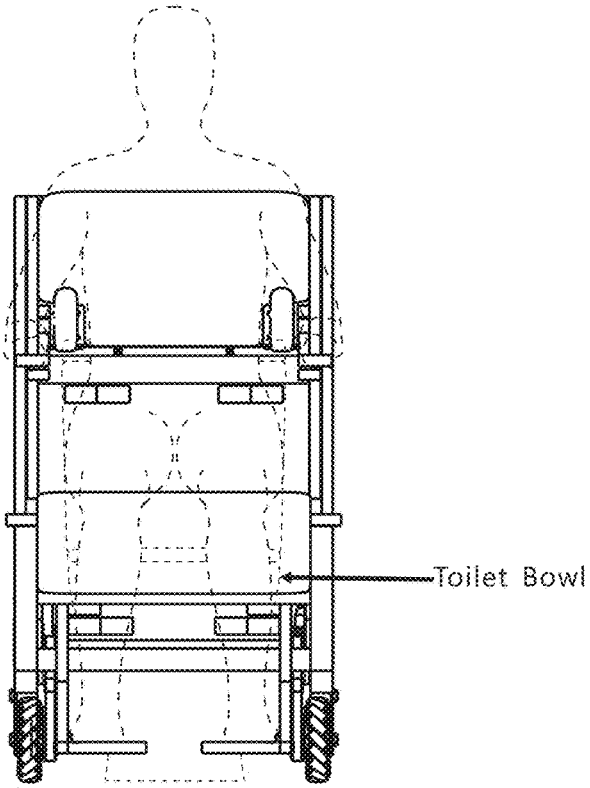
FIG. 6 illustrates a front view of the wheelchair assembly, in accordance with an embodiment of the present application.

Referring to FIG. 5, a side view of the assembly of the wheelchair with a user is illustrated, in accordance with an embodiment of the present application. Now referring to FIG. 6, a front view of the assembly of wheelchair with the user is illustrated in accordance with an embodiment of the present application. As illustrated in FIG. 5 and FIG. 6, the wheelchair assembly is positioned above the toilet vessel. The dotted structure of human represents the user who is accommodated on the seat of the wheelchair. The position of the wheelchair is such that the toilet vessel is below the seat wherein the lower space of the wheelchair has an empty space to accommodate the toilet vessel. The toilet vessel along with the flush tank and other auxiliary components are represented with dotted lines in both figures. The armrest 451 in the present embodiment is in horizontal position. Furthermore, the armrest 451, the body holder 436 and the footrest 426 are in lower position. In one embodiment, the position of the wheelchair along with the user is the preferred position to transform the wheelchair assembly for toilet accessibility wherein the wheelchair assembly undergoes a plurality of mechanical transformations to make the toilet vessel available for the user through the seat space.

Figure 7:
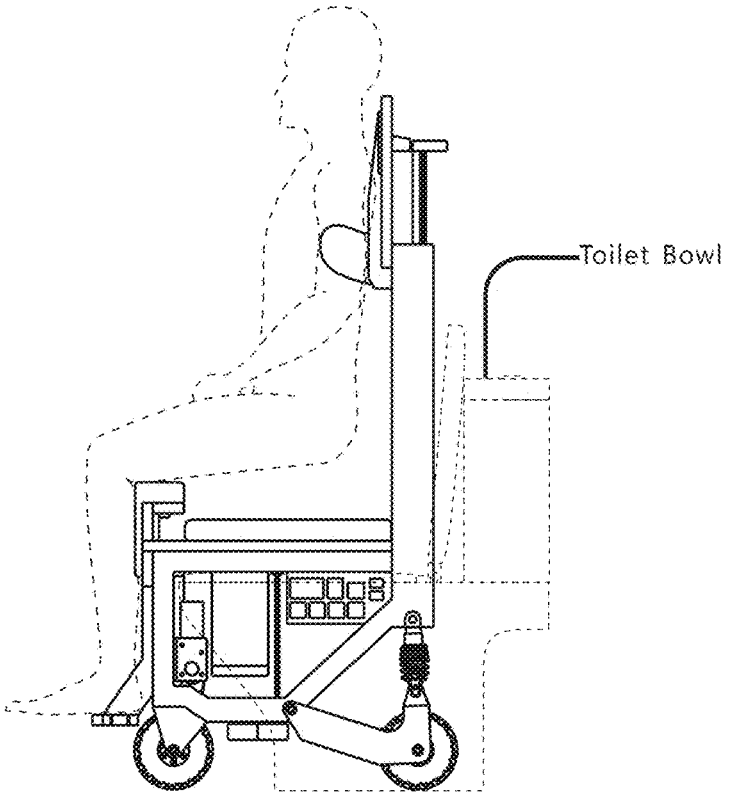
FIG. 7 illustrates a transformation mechanism of the wheelchair assembly wherein the user is pulled up and held by the mechanical system, in accordance with an embodiment of the present application.
Figure 8:
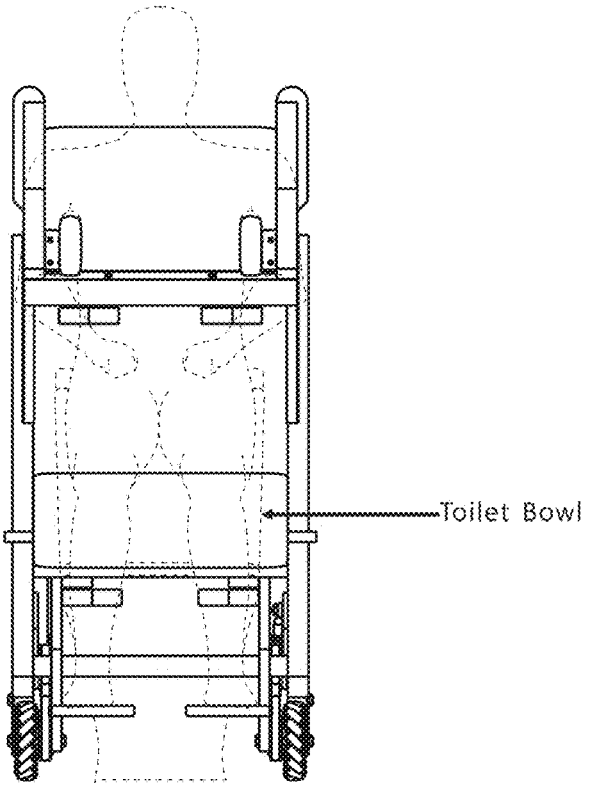
FIG. 8 illustrates a front view of the transformation mechanism of the wheelchair assembly wherein the user is pulled up and held by the mechanical system, in accordance with an embodiment of the present application.

Referring to FIG. 7, a transformation mechanism of the wheelchair assembly wherein the user is pulled up and held by the mechanical system is illustrated, in accordance with an embodiment of the present application. Further, referring to FIG. 8, a front view of the transformation mechanism of the wheelchair wherein the user is pulled up and held by the mechanical system is illustrated, in accordance with an embodiment of the present application. In an embodiment, the armrest 451, the body holder 436 and the footrest 426 are raised upwards which holds the user of the wheelchair assembly to lift the user in upward direction. In an embodiment, the armrest 451 is rotated and made vertical which further facilitates in holding the user. Such lifting of the user provides ample space for the seat to retract during seat retraction. As can be seen from the FIG. 7 and FIG. 8, the total weight of the user body is carried by the seat edge, foot rest unit and the body holder. The load of the user body is then transferred to the ground through the chair frame. In an embodiment, the lifting of the body further removes the structural constraints which enable the linkages and actuators of the seat panel to retract in the space made available below the user.

Figure 9:
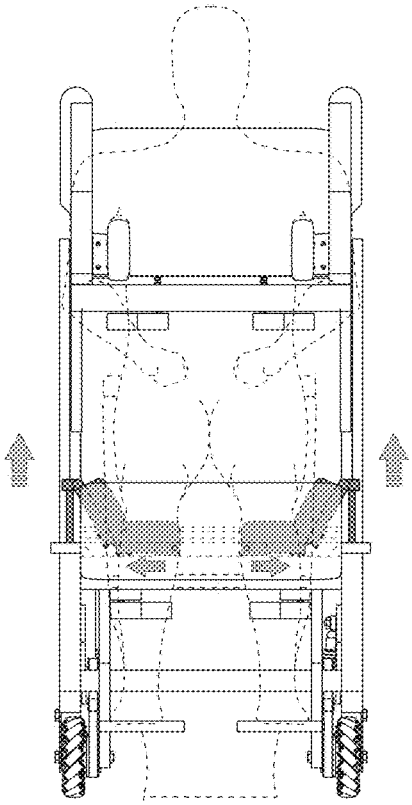
FIG. 9 illustrates a front view of the continued transformation mechanism with partial seat retraction, in accordance with an embodiment of the present application.

Now referring to FIG. 9, a front view of the continued transformation mechanism with partial seat retraction is illustrated, in accordance with an embodiment of the present application. In an embodiment, the user is lifted above by the body holder 436 wherein the load of the user is transferred from the body holder 436 to the backrest lifting unit 43 and seat edge and foot rest unit 42. Once the user is lifted at a predefined height, the seat and the seat retracting unit 44 initiates the retraction of seat panels. The couple of linear actuator C 445 and D 446 move in synchronous to lift the outer half of the seat panel. The movement of the linear actuator will enable to pull the left seat panel 448 and right seat panel 449 in the upward direction. The retraction of the seat panels is illustrated in the FIG. 9 with horizontal arrows for the inner half panels and the vertical arrows for the outer half panels.

Figure 10:
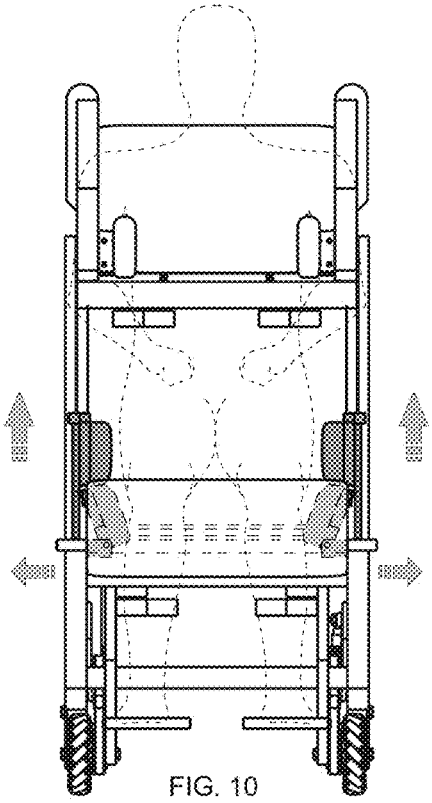
FIG. 10 illustrates a front view of the continued transformation mechanism illustrated with full seat retraction, in accordance with an embodiment of the present application.

Referring to FIG. 10, a front view of the continued transformation mechanism with full seat retraction is illustrated, in accordance with an embodiment of the present application. In an embodiment, the couple of linear actuator C 445 and D 446 may synchronously move to lift the outer half of the seat panel more towards the upward direction which further lifts the inner panels of the seat to shift from horizontal position to vertical position. Such retraction may be observed in the left seat panel 448 (both outer and inner) and right seat panel 449 (both outer and inner) in upward direction as shown in FIG. 10.

Figure 11:
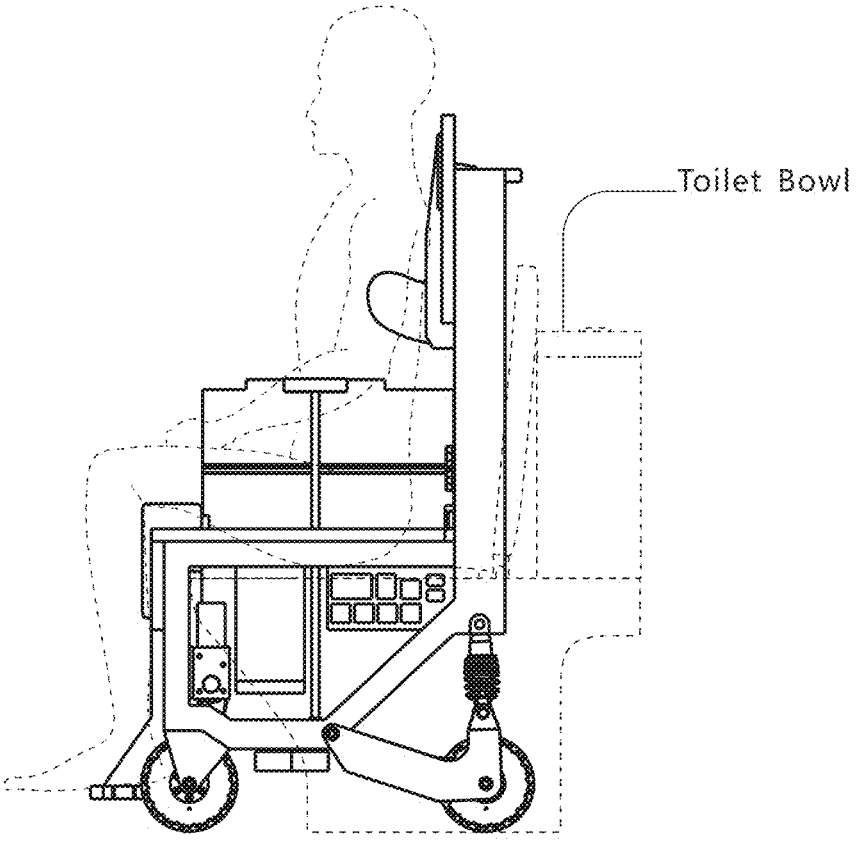
FIG. 11 illustrates a front view of the wheelchair assembly with a complete toilet accessibility transformation, in accordance with an embodiment of the present application.

Now referring to FIG. 11, a front view of the wheelchair assembly with a complete toilet accessibility transformation is illustrated, in accordance with an embodiment of the present application. After complete retraction of the seat panels, the armrest 451, the body holder 436 and the footrest 426 are lowered so that the user can access the toilet vessel. Since the seat of the user is completely retracted along the side, the user can freely access the toilet vessel without any inconvenience. Such access of toilet vessel may be enabled by slowly lowering the user through the one or more units. The user is lowered at a desired position such that the user can rest on the toilet vessel and thereby comfortably use the toilet.

Figure 12:
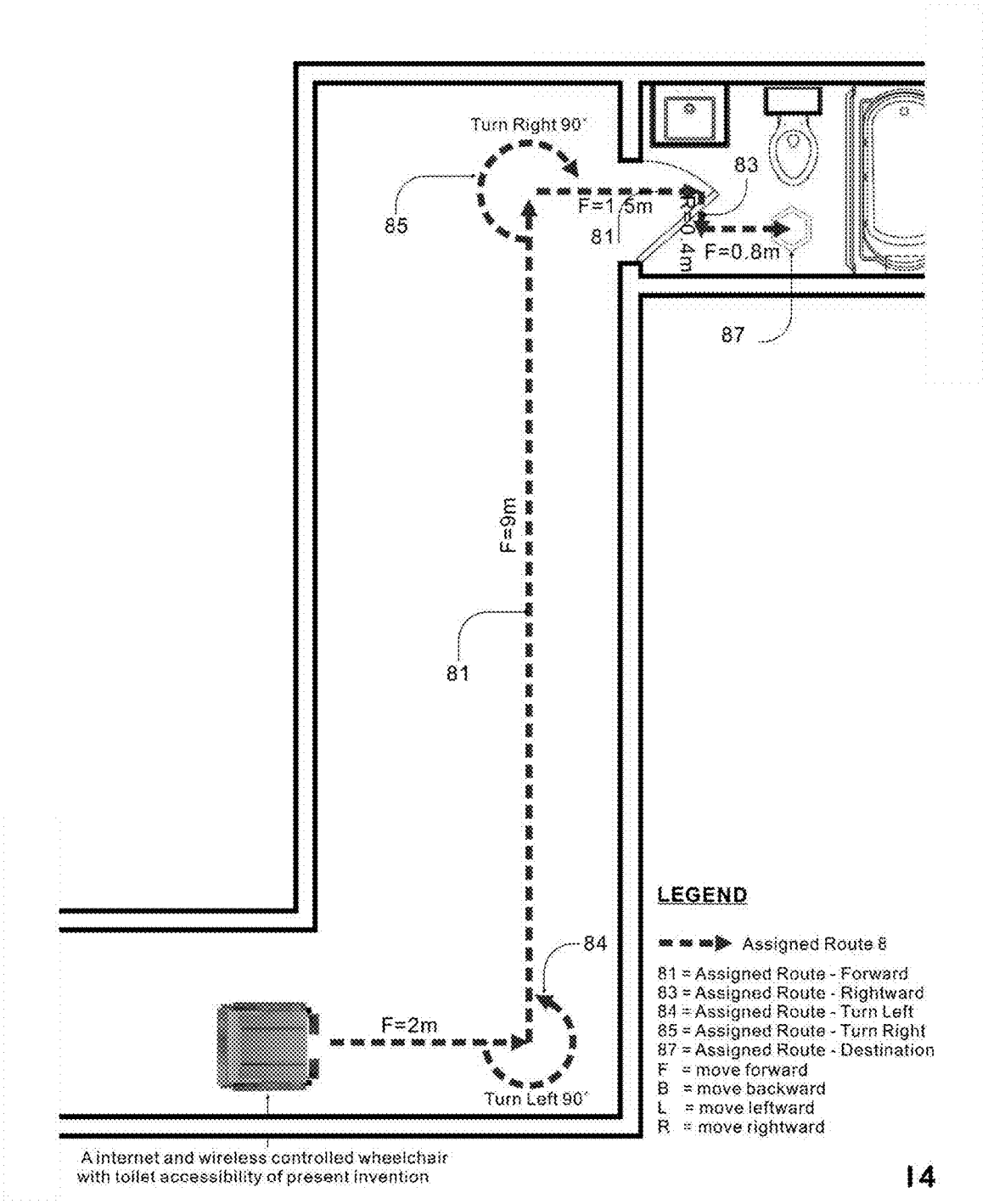
FIG. 12 illustrates a representation of an auto-pilot route which is to be performed and executed by the wirelessly controlled wheelchair is illustrated in accordance with an embodiment of the present application.

Now referring to FIG. 12, a representation of an auto-pilot route which is to be performed and executed by the wirelessly controlled wheelchair assembly is illustrated, in accordance with an embodiment of the present application. Once a route is drawn, the route may be deconstructed into a sequence of single instructions. In one example, the assigned route 8 shown in FIG. 12 is deconstructed into 8 segments of single construction further comprising:

Forward 2 m 81,
Turn left 90° 84,
Forward 9 m 81,
Turn right 90° 85,
Forward 1.5 m 81,
Rightward 0.4 m 83,
Forward 0.8 m 81, and
Operation for accessing a toilet 87

The assigned route 8 may then be followed by the wheelchair assembly wherein the microcontroller executes the plurality of commands to operate the mechanical subsystem to displace the wheelchair in accordance with the assigned route 8. In an embodiment, the sequence of single instructions once generated may be stored in the server and sent in the segment by segment manner to the wheelchair assembly. More particularly, a feedback message may be sent back to the server when a segment of assigned route is executed, and a new instruction of the next segment will be subsequently sent to the wheelchair when the server receives a return message of the completion of previous instruction. Therefore, there is no memory required for the wheelchair of the present patent application to store the entire assigned route, but execute and return feedback message for every single instruction.

Figure 13:
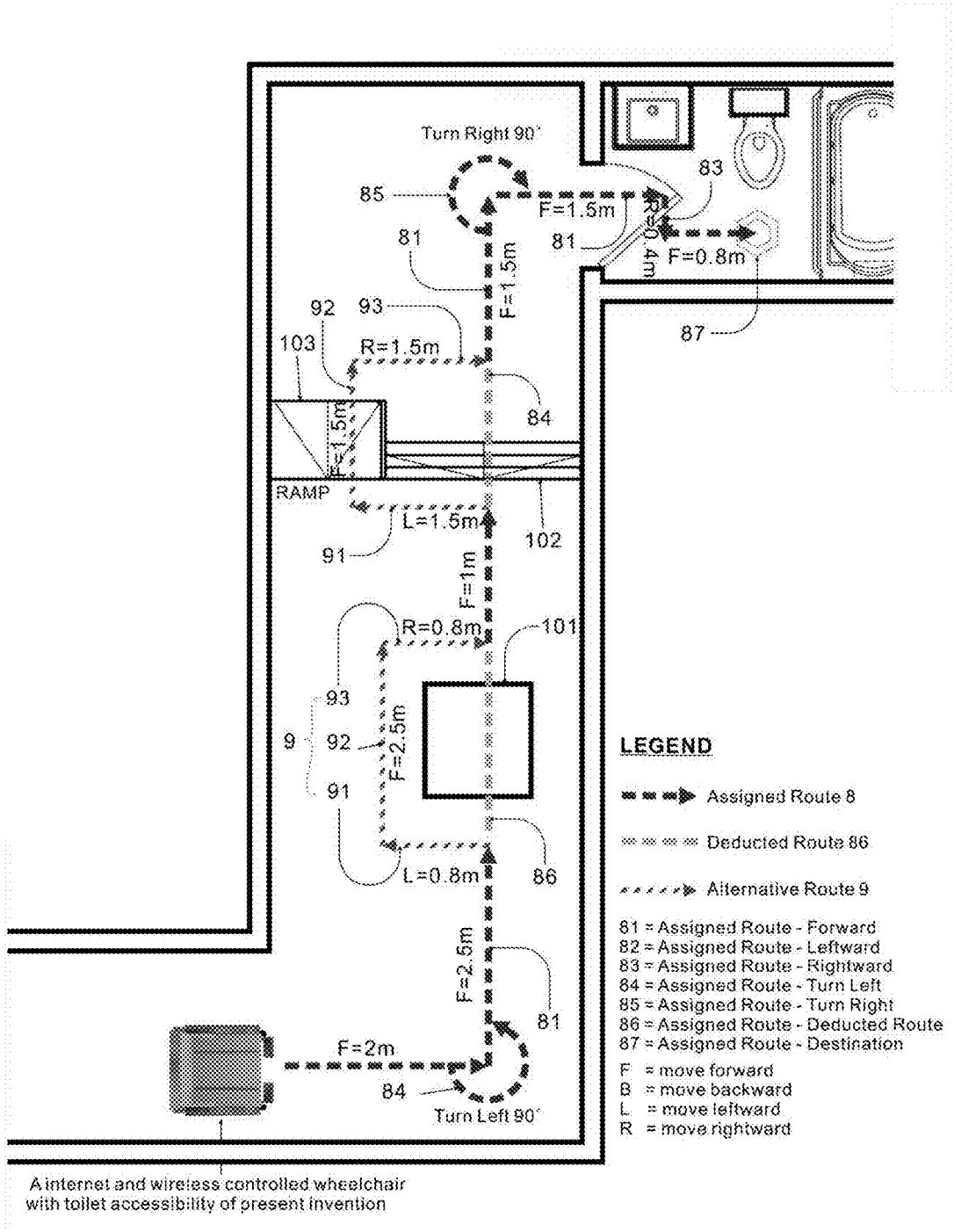
FIG. 13 illustrates a method enabling avoiding crashes and surpassing of obstacles by the wheelchair assembly, in accordance with an embodiment of the present application.

Now referring to FIG. 13, a method of avoiding crashes and surpassing of obstacles by the wheelchair is illustrated, in accordance with an embodiment of the present application. In an embodiment, in case the assigned route 8 is not properly placed or an unexpected obstacle 101 as shown in FIG. 13 is detected on the way of assigned route 8, the anti-crash unit 63 may be enabled for bypassing obstruction and steps. The ultrasonic sensors 631-634 may stop the wheelchair and pause the progress once the obstacle 101 or steps 102 are detected right in the front of the wheelchair. The ultrasonic sensors (631-634) determine an unobstructed side for move over 91 and go forward along route 92 again once no more obstacles or steps are detected in front of the wheelchair. An alternative route 9 is thereby generated for bypassing the obstacle or steps. A sideward movement 93 is the last segment of the alternative route 9 for joining back to the assigned route and resume progress. A successful bypassing of alternative route 9 may have a segment by which the progress is partially duplicated with the assigned route 8 segment. Such duplication is enabled by the distance measuring unit 62, the travel distance of the duplicated progress will be deducted subsequent to resumption of the assigned route 8 segments.

Figure 14:
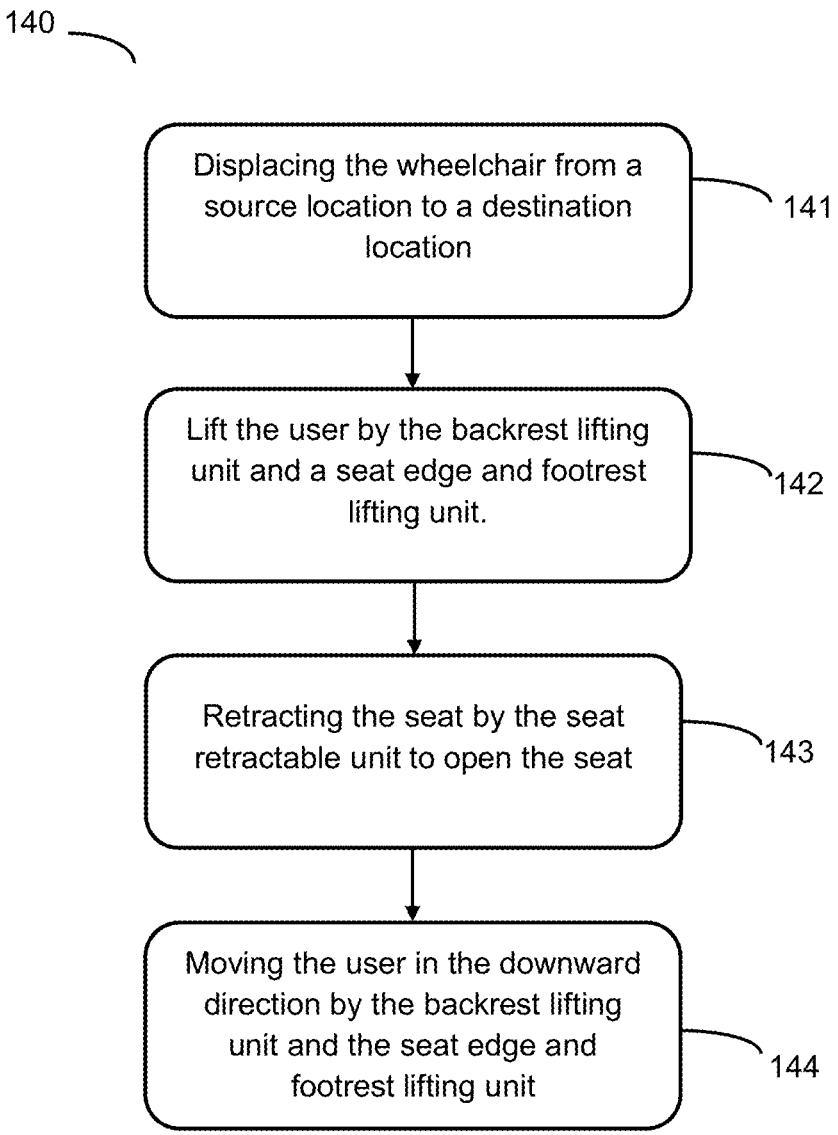
FIG. 14 illustrates a method 140 for wirelessly controlling a wheelchair assembly, in accordance with an embodiment of the application.

Now referring to FIG. 14, a method 140 for wirelessly controlling a wheelchair assembly is illustrated, in accordance with an embodiment of the application.

At step 141, the method may include displacing the wheelchair from a source location to a destination location via the wheel driving unit 41 and the microcontroller 1 in accordance with a predefined route. In one embodiment, the predefined route, including the source location and the destination location, may be set by a server communicatively coupled with the microcontroller 1. In one embodiment, the destination location may indicate a location wherein a toilet vessel is positioned. In one embodiment, the microcontroller 1 may obtain the predefined route to move the wheelchair assembly from the source location to the destination location. The microcontroller 1 may be further enabled to measure a distance travelled by the wheelchair via a plurality of sensors. The microcontroller 1 may be further enabled to detect any obstruction via a plurality of ultrasonic sensors during performing an auto-pilot movement and thereby by-pass the obstruction.

At step 142, the method may include operating, via the microcontroller 1, the backrest lifting unit 43 and a seat edge and footrest lifting unit 42 to lift the user to slightly detach from the seat.

At step 143, the method may include operating, via the microcontroller 1, the seat retractable unit 44 to open the seat by retracting the one or more panels of the seat. In one embodiment, the retraction of the seat may enable direct access of the toilet vessel to the user.

At step 144, the method may comprise operating, via the microcontroller 1, the backrest lifting unit 43 and the seat edge and footrest lifting unit 42 to move the user in the downward direction. In one embodiment, the user is moved in the downward direction such that user is enabled to sit on the toilet vessel being made accessible based upon the opening of the seat.

Figure 15:
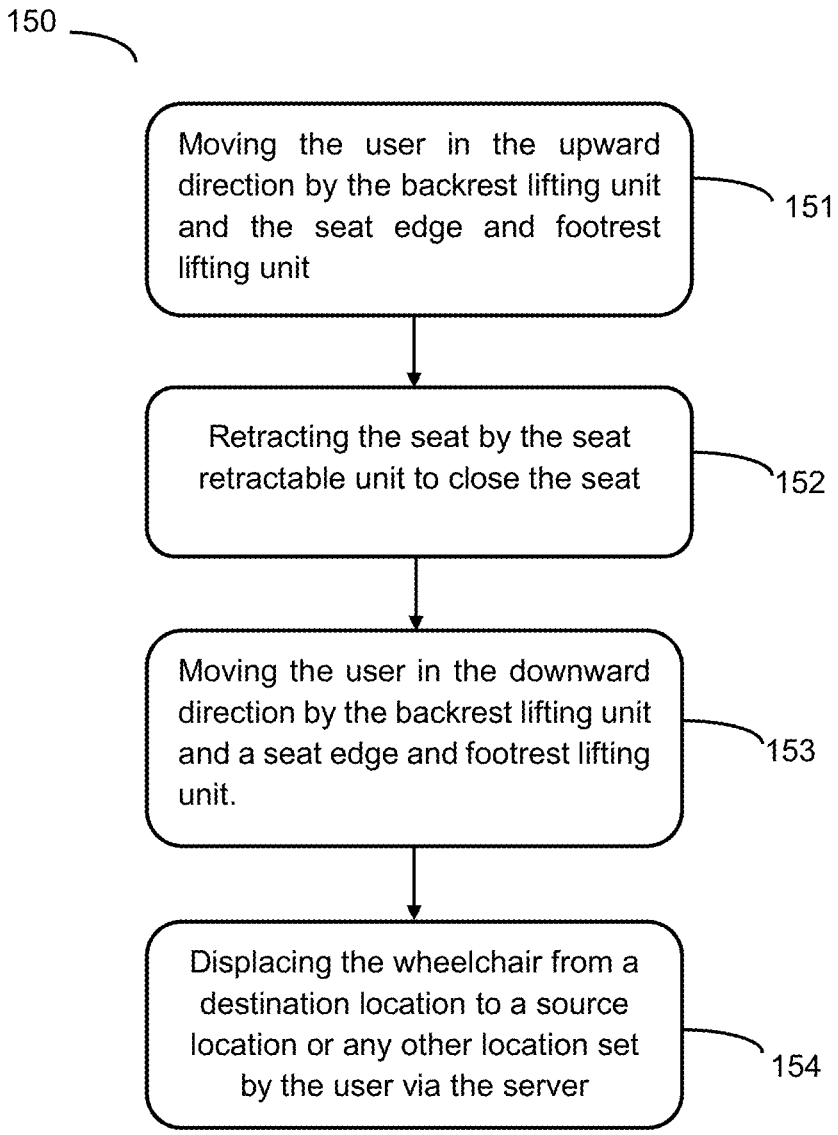
FIG. 15 illustrates a method 150 for wirelessly controlling a wheelchair assembly from the toilet accessibility position to the source point or any other point defined by the user, in accordance with an embodiment of the application.

Now referring to FIG. 15, a method 150 for wirelessly controlling a wheelchair assembly is illustrated wherein the wheelchair assembly is operated to restore the user to a normal sitting position from the toilet accessibility position.

At step 151, the method of restoring may include operating, via the microcontroller 1, the backrest lifting unit 43 and the seat edge and footrest lifting unit 42 to move the user in the upward direction such that user is held by the backrest lifting unit 43 and the seat edge and footrest lifting unit 42.

At step 152, the method of restoring may include operating, via the microcontroller 1, the seat retractable unit 44 to close the seat by retracting the one or more panels of the seat. In one embodiment, the closing of the seat may enable the user to sit on the seat.

At step 153, the method of restoring may include operating, via the microcontroller 1, the backrest lifting unit 43 and the seat edge and footrest lifting unit 42 to move the user in downward direction such that the user is able to rest on the seat of the wheelchair.

At step 154, the method of restoring may include displacing, via the wheel driving unit 41 and the microcontroller 1, the wheelchair from the toilet location to the source location or any other location set by the user via the server.

A person skilled in the art would easily realize and appreciate that, although the present disclosure is enabled to assist the disabled user in accessing the toilet from a source to the destination point, the destination point indicating a location where a toilet bowl/vessel is positioned, however, the wheelchair assembly can be wirelessly controlled to support varied other applications including, but not limited, enabling accessibility of a switch board to turn ON or OFF any electronic device, accessing a charging station of the wheelchair: wherein a charging point or power interface (connector) in the wheelchair is positioned beneath the seat is to be accessed for charging an electronic device (e.g. mobile phone), assisting in lifting the user in upward and downward direction and further retracting of the seat panels to enable the user to access the surrounding space of the wheelchair wherein such surrounding space is otherwise inaccessible due to the disability. Therefore, the wheelchair is capable of performing multiple functions which may aid in completing other operations other than accessing the toilet bowl.

Although implementations for arrangements and methods for wirelessly controlling a wheelchair assembly have been described in language specific to structural features and/or methods, it is to be understood that the appended claims are not necessarily limited to the specific features or methods described. Rather, the specific features and methods are disclosed as examples of implementations for wirelessly controlling a wheelchair assembly.

What is claimed is:

1. A wirelessly controlled wheelchair assembly, comprising:

a wheel driving unit capable of moving the wheelchair from one location to an other location;

a seat edge and footrest lifting unit capable of moving a seat edge and a footrest of the wheelchair along with a user in upward and downward direction;

a back-rest lifting unit capable of moving a backrest of the wheelchair along with the user in the upward and downward direction; and a seat retracting unit capable of retracting one or more panels of a seat of the wheelchair; and a microcontroller electronically coupled with the wheel driving unit, the seat edge and footrest lifting unit, the back-rest lifting unit and the seat retracting unit, wherein the microcontroller executes a plurality of commands in order to operate:

the wheel driving unit to displace the wheelchair from a source location to a destination location in accordance with a predefined route;

the backrest lifting unit and the seat edge and footrest lifting unit to lift the user in the upward direction to slightly detach from the seat;

the seat retractable unit to open the seat by retracting the one or more panels of the seat; and the backrest lifting unit and the seat edge and footrest lifting unit to move the user in the downward direction;

wherein the seat edge and footrest unit further comprises a first lifting mechanism on a pillar, wherein the pillar further comprises a first motor pair, a first linear slide rail and a first linear actuator pair, wherein a plurality of nuts of the first linear actuator pair are embedded into a front beam of a wheelchair frame of the wheelchair.

2. The assembly of claim 1, further comprising a wirelessly connected sub-system further comprising a Wi-Fi module connectively coupled with a microcontroller via a network, wherein the microcontroller is enabled to receive the plurality of commands from a server via the Wi-Fi module.

3. The assembly of claim 2, wherein:

the wheel driving unit is further enabled to displace the wheelchair from the source location to the destination location in accordance with the predefined route set by the server, wherein the destination location indicates a location wherein a toilet vessel is positioned; and the backrest lifting unit and the seat edge and footrest lifting unit are further enabled to move the user in the downward direction such that the user is enabled to sit on the toilet vessel being made accessible based upon the opening of the seat.

4. The assembly of claim 1, wherein the wheel driving unit further comprises a plurality of wheels each with an individual driving motor further driven by synchronous pulleys and belts for enabling displacement of the wheelchair.

5. The assembly of claim 1, wherein the back-rest lifting unit further comprises a second motor pair, a second linear actuator pair and a second linear slide rail pair, and wherein a plurality of nuts of the second linear actuator pair are embedded into a rear beam of the wheelchair frame.

6. The assembly of claim 5, wherein the seat retracting unit further comprises a third motor pair, a third pair of linear actuator and a third linear slide rail pair, and wherein nuts of the third pair of linear actuator are fixed with an outer shell of the actuator.

7. The assembly of claim 1, further comprising a monitoring sub-system comprising a health monitoring unit, a distance measuring unit, an anti-crash unit and an accident monitoring unit.

8. The assembly of claim 7, wherein the health monitoring unit further comprises a plurality of sensors to measure a plurality of heath parameters of the user, wherein the plurality of sensors, measuring the plurality of health parameters, further comprises at least a heart rate sensor and a blood pressure sensor.

9. The assembly of claim 7, wherein the distance measuring unit comprises a plurality of sensors to measure a distance travelled by the wheelchair, wherein the plurality of sensors, measuring the distance, further comprises at least a trigger wheel sensor and a hall sensor.

10. The assembly of claim 7, wherein the anti-crash unit further a plurality of sensors enabled to detect and by-pass an obstruction during performing a movement, wherein the plurality of sensors, detecting and by-passing the obstruction, further comprises one or more ultrasonic sensors.

11. The assembly of claim 7, wherein the accident monitoring unit further comprises a plurality of sensors to trigger an occurrence of an accident and to send an alert to a server, wherein the plurality of sensors, triggering the occurrence of the accident and sending the alert, further comprises at least a gyroscope sensor and an acceleration sensor.

* * * * *